United States Patent [19]

Walther et al.

[11] Patent Number: 4,690,160

[45] Date of Patent: Sep. 1, 1987

[54] HYDRAULICALLY OPERATED HIGH-PRESSURE PISTON PUMP

[75] Inventors: Norbert Walther, Recklinghausen; August Lucas, Datteln-Horneburg; Kurt Lorenz, Hattingen; Engelbert Bruns, Recklinghausen, all of Fed. Rep. of Germany

[73] Assignee: Firma Carl Still GmbH & Co. KG, Fed. Rep. of Germany

[21] Appl. No.: 695,443

[22] Filed: Jan. 28, 1985

[30] Foreign Application Priority Data

Jan. 28, 1984 [DE] Fed. Rep. of Germany ..... 3402920
Oct. 27, 1984 [DE] Fed. Rep. of Germany ..... 3439457
Oct. 27, 1984 [DE] Fed. Rep. of Germany ..... 3439458

[51] Int. Cl.[4] ..... B08B 3/02

[52] U.S. Cl. ..... 134/181; 134/184; 417/393

[58] Field of Search ..... 134/172, 173, 174, 180, 134/181, 184, 191; 202/241; 417/393; 277/24

[56] References Cited

U.S. PATENT DOCUMENTS

| | | | |
|---|---|---|---|
| 2,732,846 | 1/1956 | Berezny | 134/183 X |
| 3,604,433 | 9/1971 | Notthoff | 134/184 X |
| 3,659,306 | 5/1972 | Stoltze et al. | 277/24 X |
| 3,705,437 | 12/1972 | Rukavina, Jr. et al. | 134/183 X |
| 3,976,401 | 8/1976 | Mountain | 417/393 |
| 3,990,949 | 11/1976 | Ovsyannikov | 202/241 |
| 4,097,340 | 6/1978 | Pries | 134/180 X |
| 4,165,261 | 8/1979 | Henstra et al. | 134/172 X |
| 4,365,383 | 12/1982 | Bartlett | 134/172 X |
| 4,381,180 | 4/1983 | Sell | 417/393 |

FOREIGN PATENT DOCUMENTS

| | | | |
|---|---|---|---|
| 1923954 | 11/1970 | Fed. Rep. of Germany | 277/24 |
| 56-115886 | 9/1980 | Japan | 417/393 |

*Primary Examiner*—Harvey C. Hornsby

*Assistant Examiner*—Frankie L. Stinson

*Attorney, Agent, or Firm*—McGlew and Tuttle

[57] ABSTRACT

The sealing surfaces of a coke oven door are cleaned with high-pressure fluid by a hydraulically operated high-pressure piston pump which displaces either a hot or a cool conveyed media ladened with solid particles such as a coal mass and a fluid for cleansing the sealing surfaces of the coke oven doors and door frames. The pump includes a closed pump cylinder having an inlet and outlet valve for a conveyed medium at both ends of the cylinder and a partition dividing the cylinder. Inlet and outlet valves for hydraulic fluid are located in the cylinder on each side of the partition. An inner double piston is axially movable to and fro with the cylinder and comprises two output piston portions with a piston rod connected to each portion and located between them guided on bearings in the cylinder. A delivery space is formed between the piston portions and each end of the pump cylinder and the respective delivery spaces at each end simultaneously and oppositely decrease and increase during an operation. The hydraulic space is formed between the piston portions at each side of the partition and the hydraulic space also simultaneously and oppositely increase and decrease during operation. The pump is connected to a coke door cleaning apparatus for the purpose of cleaning an annular sealing surface. The apparatus includes a generally rectangular annular sealing surface trackway around the sealing surfaces of the door and a support structure adjacent the sealing surface having a sliding support surface trackway adjacent the door. A sliding support moves over the support surface. A nozzle lance is carried on the support and has an end with a nozzle directed at the sealing surface and an opposite end with a cleaning liquid connection through a hose to the high-pressure piston pump.

7 Claims, 5 Drawing Figures

HYDRAULICALLY OPERATED HIGH-PRESSURE PISTON PUMP

FIELD AND BACKGROUND OF THE INVENTION

This invention relates in general to coke ovens and in particular to a new and useful high-pressure hydraulic pump for use in cleaning the sealing surfaces of the ovens and to an improved hydraulically operated sealing surface cleaning apparatus.

For use under heavy duty conditions, such as in plants for extracting oil from coal, no piston pumps are known up to the present time which would stand the high-pressures required, and have also the needed capacities. The main problem is, that in conventional piston pumps, the piston packings toward the atmosphere are not satisfactory, and leaks to the outside occur time and again. It is known to work in the packing areas with additional flushing oil which then escapes at the packing locations in considerable amounts and is usually collected; yet the flushing oil consumption in such cases is disproportionately high.

From German patent No. 21 43 595 there is known a method of cleaning doors and/or door frames of horizontal coke ovens by applying high-pressure liquid jets to remove deposits from the sealing surfaces. The equipment there described comprises a plurality of high-pressure nozzles which are disposed around the entire periphery of the doors or frames and connected through a collecting line to a high-pressure pump. These high-pressure nozzles are fixedly mounted on the cleaning equipment and are actuated all simultaneously. All the nozzles are accommodated within a large cowl through which the mist of liquid and dirt is exhausted. This means that the height of the cowl must be at least equal to that of the door or frame. The water amounts needed for a simultaneous cleaning of the entire door circumference are considerable. The same goes for the exhaust power for such large cowls. Nothing is taught in that disclosure about the pump for the high-pressure cleaning water.

SUMMARY OF THE INVENTION

The present invention is directed to a suitable high-pressure piston pump having none of these drawbacks and substantially reducing or even eliminating the need of flushing oil, and being useable in various fields, particularly of the coking industry.

The inventive hydraulic high-pressure piston pump substantially comprises a pump cylinder, a double piston, and inlet and outlet valves.

The cylinder is partitioned into two delivery spaces, and two hydraulic spaces. The result thereby obtained is that none of the moving parts comes into direct contact with the atmosphere. The plain bearings are located in the hydraulic spaces and the entire pump cylinder is divided in two halves. The needed hydraulic pressure is produced by a conventional hydraulic pump. In comparison with usual pistons with a crank drive, a double piston virtually has no idle stroke. Although the unit is substantially small and has a relatively low piston speed, a larger output is thus obtained than with crank driven piston pumps or multistage plunger pumps.

The inventive pump differs from prior art pumps in the following:

a. No piston packing toward the atmosphere is provided, so that no stuffing-box leaks to the outside occur.

In prior art pumps, the solid matter-laden conveyed medium is usually compressed directly by the piston. This involves a risk that the medium escapes through the packing between the piston and the cylinder and destroys the packing very rapidly, particularly because of the solid particles present. A way out is a flushing oil supply to the packing between the piston and the cylinder, under a pressure exceeding that in the delivery space. This causes a considerable stuffing-box leak toward the atmosphere. In accordance with the invention, only small amounts of hydraulic fluid escape at the circumference of the pistons, from the hydraulic spaces to the delivery spaces.

b. Only one bearing, or three at most, are provided, as compared to the at least seven in a prior art pump of the same capacity.

c. No crank shaft is needed.

d. The inventive pump has a substantially smaller cylinder clearance ratio than pumps with a hydraulic linkage, and therefore a better volumetric output.

e. No direct cooling is necessary; in addition, the inventive pump has f. a very small flushing oil consumption;

g. a smaller number of parts subjected to wear;

h. a small weight (60% less); and i. occupies a smaller space;

j. is less expensive and k. saves maintenance time and is easier to maintain.

To minimize the mechanical load on the front walls of the double cylinder, exerted by the reciprocating double piston, the invention provides that the double piston is magnetically or mechanically braked in time at the front walls. Also, the supply of hydraulic fluid into the hydraulic spaces is correspondingly automatically controlled through the inlet and outlet valves.

Since to move the pistons, the hydraulic spaces are always under some excess pressure relative to the adjacent delivery spaces, a little amount of hydraulic fluid penetrates into the delivery spaces through the piston ring packings, which is desirable. This penetration is maintained within the desired limits, in accordance with the invention, by providing in the circumferential portions of the pistons adjustable bores extending radially outwardly and letting pass therethrough definite amounts of hydraulic liquid as flushing means.

Primarily, these controlled amounts of hydraulic fluid prevent solid particles contained in the delivered medium from depositing on the piston ring packings.

The high-pressure piston pump is particularly usable on service machines of horizontal coke oven batteries, which travel along the battery and are equipped with high-pressure nozzles to clean the sealing surfaces of coke oven doors and frames. A high-pressure pump for such a purpose is known from German patent No. 32 36 151. That prior art pump comprises two hydraulically operated multistage plunger pumps which are connected in parallel for alternate operation. Aside from requiring two pumps,the above-mentioned problem arises of sealing the pistons toward the atmosphere. The inventive pump is therefore particularly suitable in this application, since it also occupies much less space on the service machine. This is a great advantage especially for reequipment.

The inventive combination of a hydraulically operated highpressure piston pump with high-pressure nozzles and a directly surrounding exhaust cowl makes it possible to jet the cleaning water under extremely high pressures onto the sealing surfaces and to directly exhaust the forming mist of water and dislodged dirt particles. The particular advantage of this arrangement is that only a relatively small amount of water mist and solid particles is to be exhausted, and from a very small space. The sealing surface area of the exhaust cowl in contact with the door is very small so that the amount of air infiltrated from the outside is minimized.

It has been found advantageous for the high-pressure cleaning operation to provide at each side of the coke oven door, for example at the sealing blade, a pair of high-pressure nozzles which work alternately always from above downwardly. By supplying always only one pair of nozzles, the high-pressure water amount to be supplied per unit of time can further considerably be reduced, as compared to the prior art arrangements. At the same time, of course, through proper shutoff mechanisms, the exhaustion can be controlled to work only at the side where the nozzles are supplied.

In accordance with the invention, and as usual with high-pressure nozzles, the exhaust cowl may be connected to fixed fittings on the service machine through hoses. However, it has been found advantageous to connect the exhaust cowl, to an exhaust duct having the shape of a frame and being displaceable toward door surfaces to be cleaned. As compared to a flexible hose, such an exhaust duct is much more stable and less sensitive to clogging and may be cleaned in a simple way if needed.

Preferably, the duct is lined with Teflon, to prevent solid matter from depositing and baking on. Water and solid particles which might have leaked from the exhaust cowl in spite of the intense suction, are collected in a tub below the cleaning equipment and drained to a waste water tank. Since during the operating, the exhaust cowl is guided along the surfaces to be cleaned at the circumference of the door, a complete sealing against the door is not always possible.

Therefore, to avoid emission, elastic sealing elements are provided between the door and the opposite structures such as the cleaning chamber and/or the exhaust duct, which apply against the door of the door plug.

Accordingly, it is an object of the invention to provide an improved hydraulically operated high-pressure piston pump particularly for cleaning sealing surfaces of a coke oven.

A further object of the invention is to provide a coke oven door cleaning apparatus which includes a support structure for supporting a movable sliding support member carrying a fluid lance member so that its nozzle may be moved around the sealing surfaces of a coke oven door.

A further object of the invention is to provide means for cleaning a coke oven which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
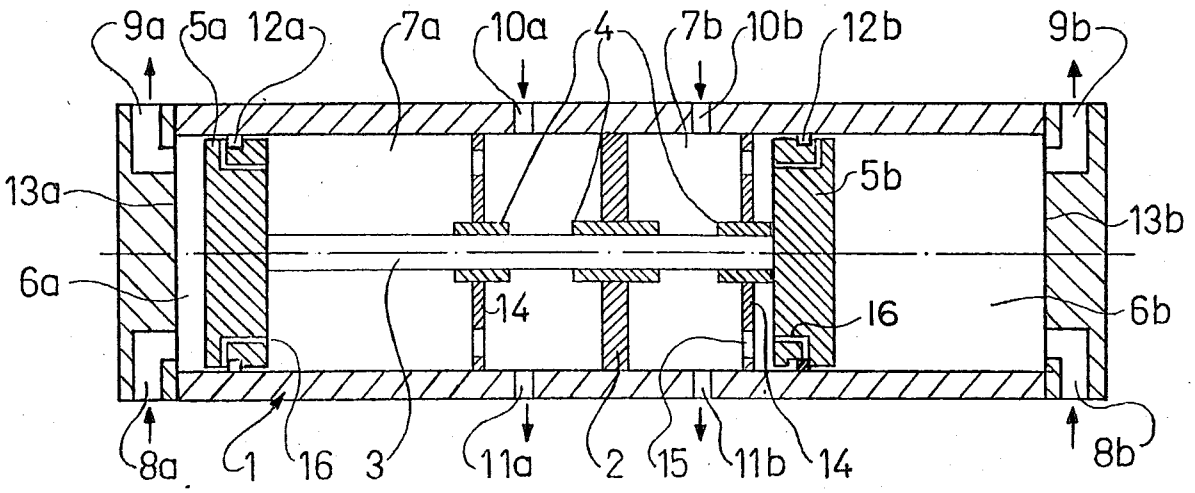
FIG. 1 is a diagrammatical sectional view of a hydraulically operated high-pressure pump.
Figure 2:
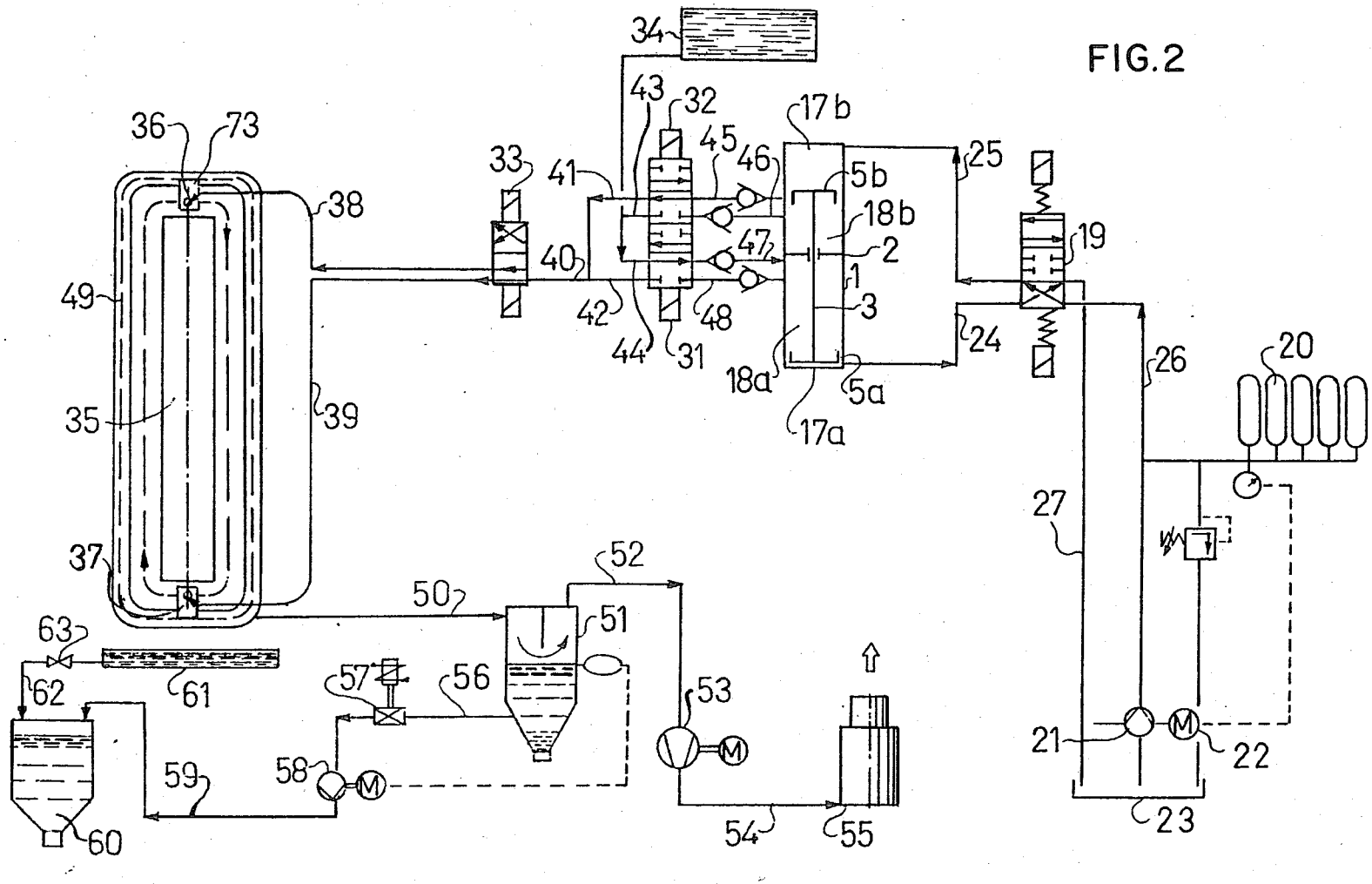
FIG. 2 shows schematically how the pump is employed in a high-pressure pump system for cleaning contact surfaces of coke oven doors.

Referring to the drawings in particular the invention embodied therein comprises a hydraulically operated high-pressure piston pump generally designated 1 in FIG. 1 which is used in the coke oven door cleaning apparatus shown in FIG. 2 for cleaning the sealing surfaces of a coke oven door 70. The pump 1 is operated with a hydraulic fluid. The needed pressure of the hydraulic fluid is produced by a conventional hydraulic pump. A conventional hydraulic pump is suitable since a clean hydraulic liquid free from solid matter does not overstress the piston packings.

The following operating phases or positions are to be disinguished in an inventive hydraulic piston pump:

1. Inlet valve **10*b* and outlet valve 11*a*** for the hydraulic liquid open simultaneously.

2. Inlet valve **10*a* and outlet valve 11*b* for the hydraulic liquid close simultaneously, consequently hydraulic liquid flows into hydraulic space 7*b* and is discharged from hydraulic space 7*a***.

3. Piston **5*b* moves in the direction of a first end wall 13*b*, while piston 5*a* simultaneously moves away from second end 13*a*. At the same time, outlet valve 9*b* and inlet valve 8*a*** for the conveyed medium open.

4. Inlet valve **8*b* and outlet valve 9*a* for the conveyed medium close, consequently, conveyed medium flows into delivery space 6*a* and out of delivery space 6*b***.

The pump cylinder 1, as shown in FIGS. 1 and 2 terminates with front or end walls **13*a* and 13*b* in which inlet and outlet valves 8*a*, 8*b*, 9*a*, 9*b* for the conveyed medium are provided. Between the end walls 13*a* and 13*b*, a partition 2 is provided separating two third medium spaces 7*a*, 7*b*. The two pistons 5*a*, 5*b* are connected to each other by a piston rod 3 which is guided in plain bearings 4 provided in partition 2 and in two additional bearing supports 14. Bearing supports 14 are spaced apart from partition 2 and have passage openings for the hydraulic fluid. In the zones between partition 2 and bearing supports 14, inlets 10*a*, 10*b* and outlets 11*a*, 11*b* for the hydraulic fluid are provided in the cylindrical wall of cylinder 1. Pistons 5*a* and 5*b* have annular grooves that movably carry piston ring packings 12*b*, 12*b* on their circumference, to seal spaces 7*a*, 7*b* against delivery spaces 6*a*, 6*b*. To ease the sliding of the piston rings or packings on the inside of the pump cylinder, adjustable bores 16 are provided in the pistons, opening radially to permit hydraulic fluid to flow as a flushing liquid to the circumference of the respective piston. Bores 16 are opened and closed by movable packings 12*a* and 12*b* as pistons 5*a*, 5*b* move back and forth in the cylinder 1**.

The equipment diagrammatically shown in FIG. 2 is intended for cleaning the sealing blade of coke oven doors, and the gap between the plug holder and the sealing blade. These surfaces to be cleaned of the coke oven door are indicated in FIG. 2 as an oblong rectangle 35. The high-pressure nozzles 36 and 37 are moved along the sealing surfaces by means of suitable sliding supports, and they are connected to the delivery side of the high-pressure piston pump through flexible supply lines 38, 39. The sealing surfaces 35 are cleaned alternately at opposite sides. The sliding supports carrying the high-pressure nozzles 36, 37 are first moved along half the oblong rectangle 35, for example in the clockwise direction as shown by arrows, during which motion the nozzle 36 is supplied and in operation. Then, the movement is reversed and the other nozzle 37 is supplied and in operation, since it now moves downwardly. The alternate supply of water or cleaning fluid to the two high-pressure nozzles is effected by switching a valve 33. Further valves 31 and 32 are used for switching the supply at discharge lines to the suction and delivery sides of the high-pressure piston pump. The supply and discharge of the hydraulic fluid is effected by switching a valve 19.

The pump operates as follows: to move piston rod 3 down (to the left in FIG. 1) hydraulic liquid is pumped under a pressure of 100 to 160 bar from a reservoir 20 through lines 26 and 25 into hydraulic space 17*b*. At the same time, hydraulic liquid returns from hydraulic space 17*a* through lines 24 and 27 into a reservoir 23 for hydraulic liquid. During this downward motion of piston rod 3, delivery space 18*a* grows larger and water is taken in from a water tank 34 through lines 44 and 47. At the same time delivery space 18*b* grows smaller and the water therefrom is discharged under a pressure of 300 to 500 bar through lines 45, 41 and 40 to high-pressure nozzle 36 or 37. During this operation, the flushing bores 16 on piston 5*b* shown in FIG. 1 are closed, and lines 46 and 48 are shut off. After the flow is switched from line 26 to line 27, (by switching valve 19), the movement of piston rod 3 is reversed. Lines 45 and 47 are shut off while lines 46 and 48 are opened. The high-pressure water is taken in through lines 44, 47 and flows through lines 48, 42 and 40 to the nozzles.

In addition to the arrangement of the high-pressure water supply to the nozzles, FIG. 2 also shows the exhaust duct 49 which extends along the surfaces to be cleaned (oblong rectangle 35) and through which the formed mist of water and dirt particles is taken off. The exhausted mixture passes through a line 50 into a water-and-solid separator 51, where the separated solid matter settles at the bottom and the water is directed through a line 56, a shutoff valve 57, a pump 58, and a line 59 to a waste water tank 60. Water and solid matter which might have leaked through the exhaust cowls of the nozzles drop into a collecting tube 61 provided below the equipment and pass therefrom through a shutoff valve 63 and a line 62 also to waste water tank 60. While the separator 51 and the associated pumps and blowers are advantageously mounted on the service car, the waste water tank 60 may be provided at a fixed location, such as on a battery head. Hydraulic fluid is pumped from reservoir 20 by a pump 21 with motor 22.

Figure 3:
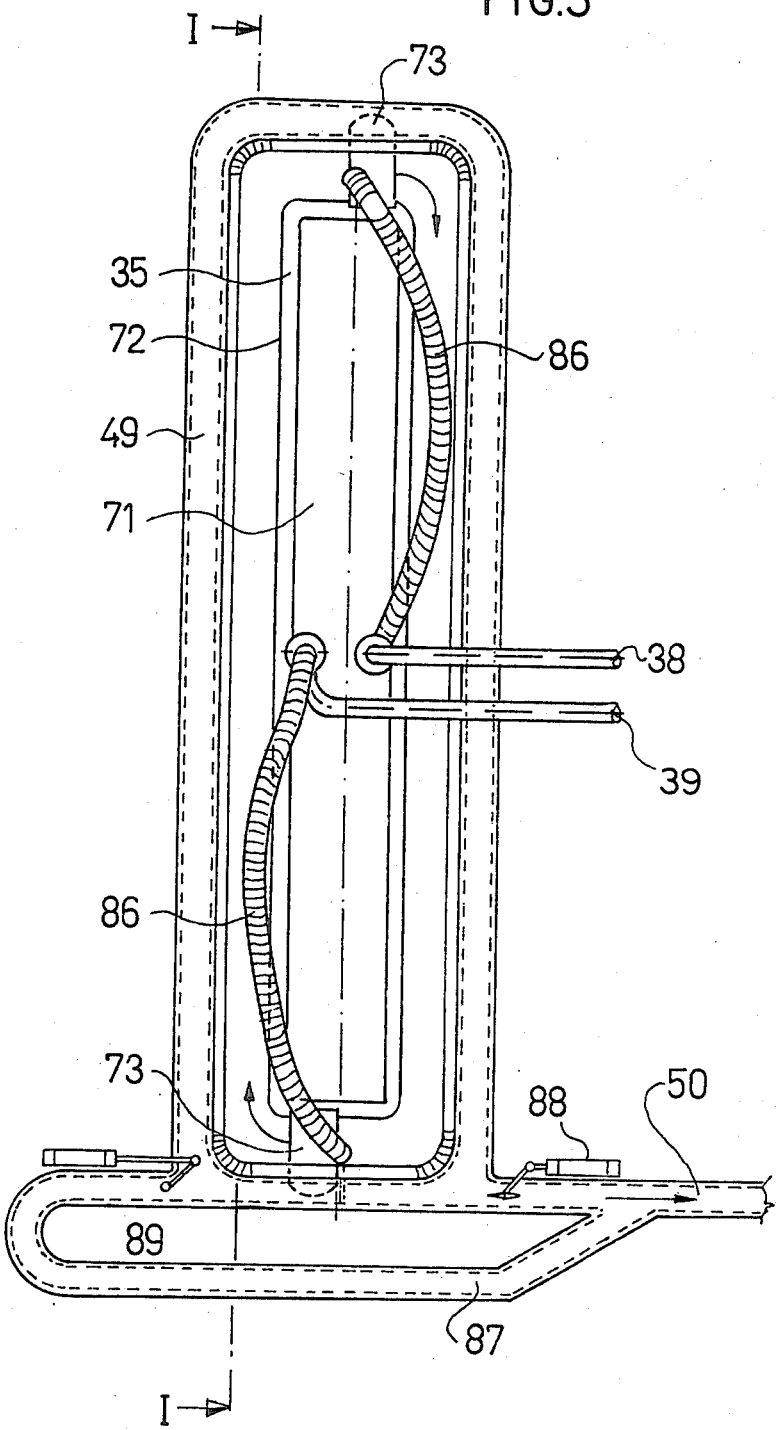
FIG. 3 is a front view of the coke door illustrating the highpressure cleaning equipment.

FIG. 3 shows two sets of high-pressure water cleaning assemblies which are displaceable around the rectangular periphery of a coke oven door. The pressure water is supplied through lines 38 and 39 which are fixed to the service car, and then through elastic hoses 86 to the high-pressure nozzles 36 which are surrounded each by an exhaust cowl 73.

Figure 4:
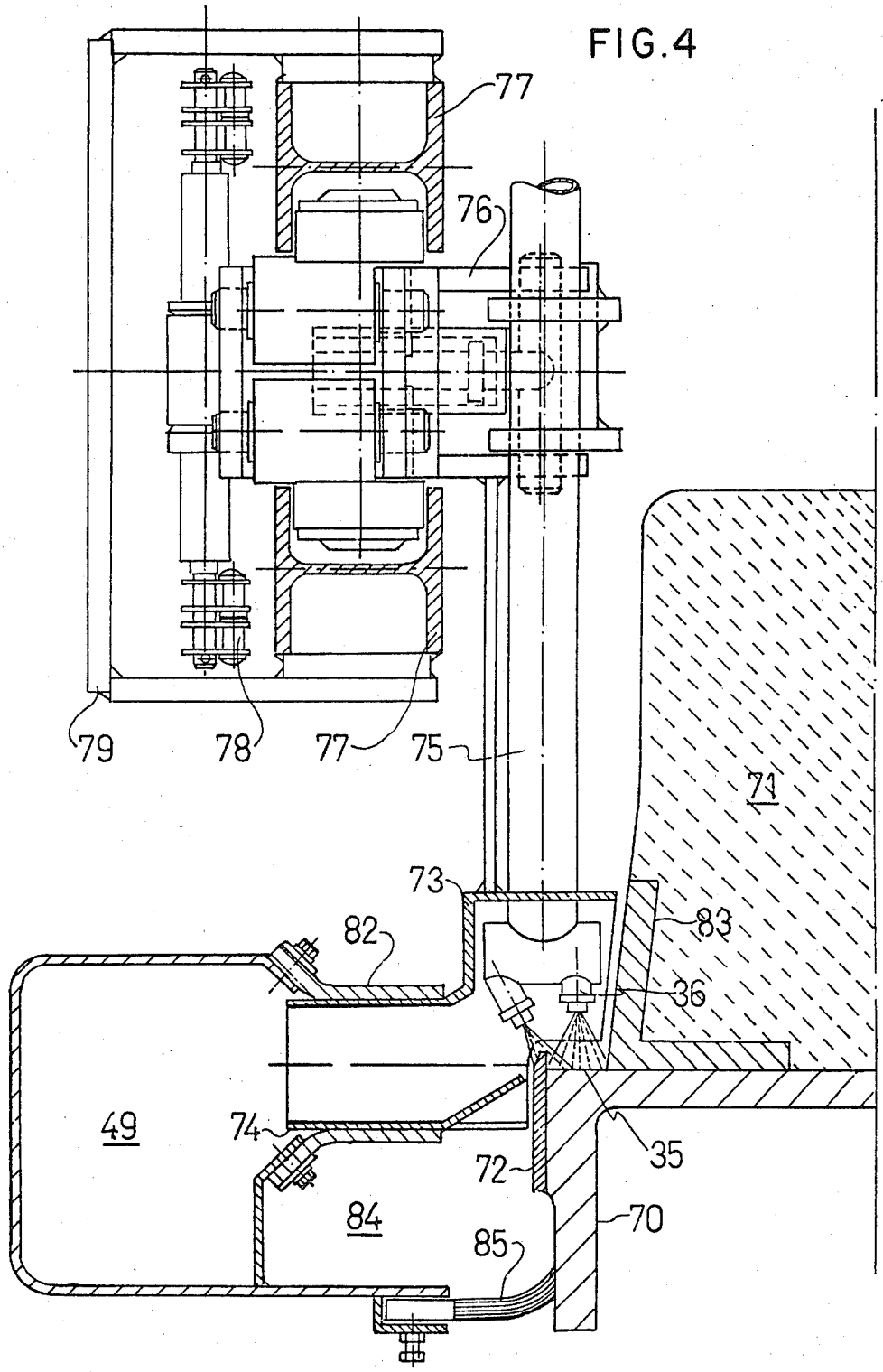
FIG. 4 is a horizontal sectional view of the cleaning equipment in position at a coke oven door.
Figure 5:
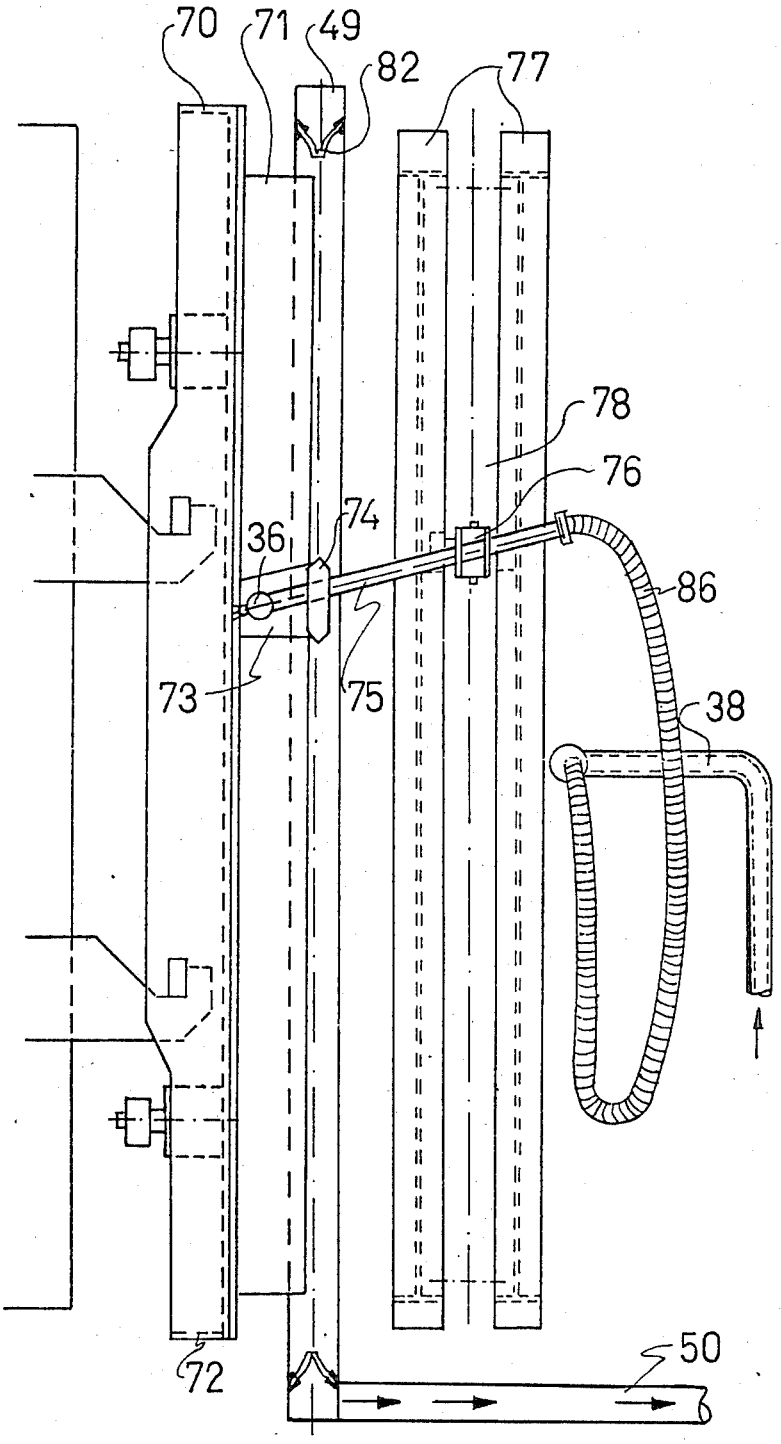
FIG. 5 is a cross-sectional view taken along the line I-I of FIG. 3, of the cleaning equipment in position at a coke oven door.

In the embodiment of FIG. 3, one exhaust cowl is provided at the upper end of the coke oven door, and another cowl is provided at the lower end. The door 70 has a plug 71 (FIGS. 4 and 5) with a frame 83 and a blade 72. Exhaust duct 49 is carried by a sliding support 76. A seal 85 engages door 70 to close a cleaning chamber 84. Water is supplied to nozzles 36 by a pipe 75 and the exhaust travels over a conduit 74 to duct 49. The two exhaust cowls 73 are moved, along with the high-pressure nozzles 36 accommodated therein, in the arrow directions along the surface 35 to be cleaned, with only the downwardly moving nozzles 36 and the associated cowls 73 being in operation in each instance. After traveling along one half of the circumference of the door, the direction of motion is reversed, and the other half of the door frame is cleaned. As shown particularly in FIG. 4, cowl 73 communicates with exhaust duct 49 through a connection 74. During the displacement of cowl 73, this connection 74 is guided in a lengthwise slot of exhaust duct 49 between rubber sealing lips 82 which are thereby pushed apart. Both exhaust cowl 73 and nozzles 36 are supported on the sliding support 76 which is movable by means of chains 78 on guide rails 77 of a guiding and lifting frame 79. According to FIG. 4, the exhaust duct side wall remote from frame 79 is sealingly applied against door body 70 through the elastic sealing member, whereby an additional cleaning chamber 84 is formed through which leaking water and solid particles may drop into the collecting tub.

At its bottom, exhaust duct 49 is equipped with throttling valves 88 and 89 and communicates through exhaust lines 87 and 50 with a solid matter separator.

While specific embodiments of the invention have been shown and described in detail to illustrate the application of the principles of the invention, it will be understood that the invention may be embodied otherwise without departing from such principles.

What is claimed is:

1. A hydraulically operated high-pressure piston pump for conveying a fluid medium at high pressure, comprising:

a closed pump cylinder defining an axially extending space, said cylinder having first and second end walls closing said axially extending space and disposed at opposite ends of said cylinder;

a partition connected in said cylinder and dividing said axially extending space into first and second spaces on opposite sides of said partition;

first and second axially spaced pistons movable axially in said first and second spaces respectively, said first and second pistons dividing said respective first and second spaces each into a fluid medium space bounded by said partition and a hydraulic fluid space bounded by one of said first and second end walls;

a piston rod fixed between said first and second pistons so that said first and second pistons move together in the same direction;

hydraulic fluid inlet and outlet valves connected into each of said hydraulic fluid spaces for supplying and discharging hydraulic fluid to and from each hydraulic fluid space;

fluid medium inlet and outlet valves connected into each of said fluid medium spaces for supplying and discharging fluid medium into and out of each of said fluid medium spaces;

a slide bearing in said partition for slidably receiving said piston rod for axial movement in said cylinder;

each of said pistons having an outer circumference adjacent said cylinder with an annular groove therein, each of said pistons having a plurality of bores extending from said annular groove to said fluid medium space;

a piston ring mounted for axial movement in each of said annular grooves, each piston ring being engaged with said cylinder disposed between said fluid medium space and said hydraulic space for each piston, each piston ring being movable over ends of said bores for its piston to close said bores with movement of its piston away from its respective end wall, each piston ring being movable to uncover ends of said bores of its piston to permit passage of hydraulic fluid from said hydraulic fluid space to said fluid medium space with movement of its piston toward its respective end wall;

switch means connected to said inlet and outlet valves for simultaneously opening said inlet valve of one fluid medium space and said outlet valve of the other fluid medium space, and for simultaneously closing said inlet valve of said other fluid medium space and said outlet valve of said one fluid medium space, said switch means simultaneously opening said inlet valve of said one hydraulic fluid space adjacent said one fluid medium space and said outlet valve of said other other hydraulic space adjacent said other fluid medium space, said switch means simultaneously closing said outlet valve of said one hydraulic fluid space and said inlet valve of said other hydraulic fluid space; and hydraulic fluid pump means connected to said switch means for supplying and receiving hydraulic fluid to and from said switch means so that hydraulic fluid is supplied to and from said hydraulic fluid spaces for moving said pistons to change volumes of said fluid medium spaces to pump fluid medium to and from said fluid medium spaces.

2. A hydraulically operated high-pressure piston pump according to claim 1 wherein said pistons have radially outwardly directed bores sized to permit the forcing of a definite amount of hydraulic fluid therethrough providing a flushing fluid discharge adjacent the circumference of said pistons.

3. A hydraulically operated high-pressure pump according to claim 2, wherein said radially outwardly directed bores open into said annular groove of its piston on a side of said annular groove adjacent said hydraulic fluid space, each bore having an axially extending portion oepning into said fluid medium space.

4. A pump according to claim 2, including a coke oven door cleaning apparatus for cleaning the sealing surfaces of a coke oven door which has an annular sealing surface, comprising means defining a generally rectangular sealing surface trackway around sealing surfaces of the coke oven door, a support structure adjacent said sealing surface having a sliding support surface adjacent the door, a sliding support movable over said support surface, a nozzle lance carried on said support and having one end with a nozzle directed at the sealing surface and an opposite end having a cleaning liquid connection connected to said switch means for receiving fluid medium from said fluid medium spaces.

5. A hydraulically operated high-pressure piston pump according to claim 1, including a coke oven door cleaning apparat for cleaning a coke oven door sealing surface, a conduit containing a nozzle discharge connected to said switch means for receiving fluid medium therefrom, and including means for moving said nozzle relative to the sealing surface.

6. A hydraulically operated high-pressure piston pump according to claim 5, including means for circulating a cleaning liquid as said fluid medium through said pump to said nozzle and for pressurizing the cleaning liquid to a pressure of 300 to 500 bars and including a hydraulic fluid operating said pump connected thereto is pressurized to a pressure of from about 100 to 160 bars.

7. A coke oven door and cleaning apparatus combination for cleaning a sealing surface of the coke oven door, comprising, a coke oven door having an annular sealing surface, means defining a generally rectangular sealing surface trackway around said sealing surface of said coke oven door, a support structure adjacent said sealing surface having a sliding support surface trackway adjacent said door, a sliding support movable over said support surface trackway, a nozzle lance carried on said support and having one end with a nozzle directed at said sealing surface and an opposite end having a cleaning liquid connection, a highpressure liquid nozzle including a cowl for exhausting a mist of liquid and dirt which is supported for movement along said trackway for moving the nozzle along said surface to be cleaned, a second sliding support arranged at spaced locations around said trackway from said first mentioned sliding support, each sliding support having a high pressure nozzle lance with a liquid nozzle discharge directed at said sealing surface, each device including a cowl for exhausting the mist of liquid and dirt and a flexible line connection to each cowl for connecting each cowl and its lance to a high-pressure liquid source, an exhaust duct having the shape of a frame which is displaceable toward said sealing surface to be cleaned, said exhaust duct having a sealing opening facing said sealing surface, each cowl having a projecting connection which protrudes into and is displaceable along the sealing opening of said exhaust duct in the longitudinal direction thereof, means sealing said projecting connection to said exhaust duct including elastic sealing elements, a further seal connected to said exhaust duct and engaged against said coke oven door for sealing said exhaust duct to said coke oven door, and a collecting tube connected below said coke oven door for collecting water and solid matter which is directed off said door by said cleaning apparatus.

* * * * *